US010861484B2

(12) United States Patent
Steele et al.

(10) Patent No.: US 10,861,484 B2
(45) Date of Patent: Dec. 8, 2020

(54) METHODS AND SYSTEMS FOR SPEECH DETECTION

(71) Applicant: Cirrus Logic International Semiconductor Ltd., Edinburgh (GB)

(72) Inventors: Brenton R. Steele, Victoria (AU); David Watts, Edinburgh (GB)

(73) Assignee: Cirrus Logic, Inc., Austin, TX (US)

( * ) Notice: Subject to any disclaimer, the term of this patent is extended or adjusted under 35 U.S.C. 154(b) by 83 days.

(21) Appl. No.: 16/214,478

(22) Filed: Dec. 10, 2018

(65) Prior Publication Data

US 2020/0184996 A1 Jun. 11, 2020

(51) Int. Cl.
*G10L 25/84* (2013.01)
*G10L 25/78* (2013.01)

(52) U.S. Cl.
CPC ..... *G10L 25/84* (2013.01); *G10L 2025/786* (2013.01)

(58) Field of Classification Search
CPC . A63F 13/86; A63F 13/79; G06F 9/45; G06F 3/167; G10L 15/22; G10L 21/0232; G10L 25/78; G10L 25/84; G10L 2025/786; G10L 17/26; G10L 25/06; H04R 1/10; H04R 1/1016; H04R 1/1041; H04R 1/1083; H04R 3/005; H04R 25/554; A61B 5/1118
USPC ..... 434/185; 704/207, 233, 236, 275, 205, 704/210, 227; 381/94.3
See application file for complete search history.

(56) References Cited

U.S. PATENT DOCUMENTS 4,777,649 A * 10/1988 Carlson ..... G10L 25/78 381/122
4,811,404 A * 3/1989 Vilmur ..... G10L 21/0208 327/552
5,999,897 A * 12/1999 Yeldener ..... G10L 25/90 704/207
6,104,993 A * 8/2000 Ashley ..... G10L 25/78 381/94.1
6,415,253 B1 * 7/2002 Johnson ..... G10L 21/0208 381/94.2

(Continued)

FOREIGN PATENT DOCUMENTS

EP 2811485 A1 12/2014
JP 2003264883 9/2003
WO 2016209530 A1 12/2016

*Primary Examiner* — Gerald Gauthier
(74) *Attorney, Agent, or Firm* — Jackson Walker L.L.P.

(57) ABSTRACT

Embodiments generally relate to a device comprising at least one signal input component for receiving a bone conducted signal from a bone conducted signal sensor of an earbud; memory storing executable code; and a processor configured to access the memory and execute the executable code. Executing the executable code causes the processor to: receive the bone conducted signal; determine at least one speech metric for the received bone conducted signal, wherein the speech metric is based on the input level of the bone conducted signal and a noise estimate for the bone conducted signal; based at least in part on comparing the speech metric to a speech metric threshold, update a speech certainty indicator indicative of a level of certainty of a presence of speech in the bone conducted signal; update at least one signal attenuation factor based on the speech certainty indicator; and generate an updated speech level estimate output by applying the signal attenuation factor to a speech level estimate.

20 Claims, 6 Drawing Sheets

(56) References Cited

U.S. PATENT DOCUMENTS 6,453,291 B1* 9/2002 Ashley ..... G10L 25/78 704/200
8,983,096 B2 3/2015 Smith et al.
9,313,572 B2 4/2016 Dusan et al.
9,363,596 B2 6/2016 Dusan et al.
9,516,442 B1 12/2016 Dusan et al.
9,997,173 B2 6/2018 Dusan et al.
10,300,394 B1* 5/2019 Evans ..... G06F 3/048
2004/0030544 A1* 2/2004 Ramabadran ..... G10L 25/78 704/205
2005/0114127 A1* 5/2005 Rankovic ..... G10L 21/0364 704/233
2011/0208520 A1* 8/2011 Lee ..... G10L 25/78 704/233
2012/0264091 A1* 10/2012 Huber ..... G09B 19/04 434/185
2012/0323573 A1* 12/2012 Yoon ..... G09B 19/06 704/236
2013/0275128 A1* 10/2013 Claussen ..... G10L 25/78 704/233
2014/0072148 A1 3/2014 Smith et al.
2015/0179189 A1* 6/2015 Dadu ..... G10L 15/24 704/275
2016/0035359 A1* 2/2016 Pilli ..... G10L 19/012 704/210
2017/0039045 A1* 2/2017 Abrahami ..... A61B 5/1118
2017/0092269 A1* 3/2017 Haubrich ..... G10L 15/22
2017/0263267 A1* 9/2017 Dusan ..... H04R 1/1016
2018/0081621 A1 3/2018 Dusan et al.
2018/0324518 A1* 11/2018 Dusan ..... G10L 25/06
2018/0348970 A1* 12/2018 Chand ..... G11B 27/031
2018/0367882 A1* 12/2018 Watts ..... H04R 1/1083
2019/0043512 A1* 2/2019 Huang ..... G10L 17/26
2019/0272842 A1* 9/2019 Bryan ..... G10L 21/0232
2020/0184996 A1* 6/2020 Steele ..... G10L 25/84

* cited by examiner

METHODS AND SYSTEMS FOR SPEECH DETECTION

TECHNICAL FIELD

Described embodiments generally relate to methods and systems for performing speech detection. In particular, embodiments relate to performing speech detection to enable noise reduction for speech capture functions.

BACKGROUND

Headsets are a popular way for a user to listen to music or audio privately, to make a hands-free phone call, or to deliver voice commands to a voice recognition system. A wide range of headset form factors, i.e. types of headsets, are available, including earbuds. The in-ear position of an earbud when in use presents particular challenges to this form factor. The in-ear position of an earbud heavily constrains the geometry of the device and significantly limits the ability to position microphones widely apart, as is often required for functions such as beam forming or sidelobe cancellation. Additionally, for wireless earbuds, the small form factor places significant limitations on battery size and thus the power budget. Moreover, the anatomy of the ear canal and pinna somewhat occludes the acoustic signal path from the user's mouth to microphones of the earbud when placed within the ear canal, increasing the difficulty of the task of differentiating the user's own voice from the voices of other people nearby.

Speech capture generally refers to the situation where the headset user's voice is captured and any surrounding noise, including the voices of other people, is minimised. Common scenarios for this use case are when the user is making a voice call, or interacting with a speech recognition system. Both of these scenarios place stringent requirements on the underlying algorithms for speech capture. For voice calls, telephony standards and user requirements typically demand that relatively high levels of noise reduction are achieved with excellent sound quality. Similarly, speech recognition systems typically require the audio signal to have minimal modification, while removing as much noise as possible. Numerous signal processing algorithms exist in which it is important for operation of the algorithm to change, depending on whether or not the user is speaking. Voice activity detection, being the processing of an input signal to determine the presence or absence of speech in the signal, is thus often an important aspect of voice capture and other such signal processing algorithms.

However, even in larger headsets such as booms, pendants, and supra-aural headsets, it is often very difficult to reliably ignore background noise, such as speech from other persons who are positioned within a beam of a beamformer of the device, with the consequence that such other persons' speech noise can corrupt the process of voice capture of the user only. These and other aspects of voice capture are particularly difficult to effect with earbuds, including for the reason that earbuds do not have a microphone positioned near the user's mouth and thus do not benefit from the significantly improved signal to noise ratio resulting from such microphone positioning.

It is desired to address or ameliorate one or more shortcomings or disadvantages associated with prior methods and systems for the speech detection, or at least to provide a useful alternative thereto.

Any discussion of documents, acts, materials, devices, articles or the like which has been included in the present specification is not to be taken as an admission that any or all of these matters form part of the prior art base or were common general knowledge in the field relevant to the present disclosure as it existed before the priority date of each claim of this application.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

In this specification, a statement that an element may be "at least one of" a list of options is to be understood that the element may be any one of the listed options, or may be any combination of two or more of the listed options.

SUMMARY

Some embodiments relate to a device comprising:

- at least one signal input component for receiving a bone conducted signal from a bone conducted signal sensor of an earbud;
- memory storing executable code; and
- a processor configured to access the memory and execute the executable code, wherein executing the executable code causes the processor to:
  - receive the bone conducted signal;
  - determine at least one speech metric for the received bone conducted signal, wherein the speech metric is based on the input level of the bone conducted signal and a noise estimate for the bone conducted signal;
  - based at least in part on comparing the speech metric to a speech metric threshold, update a speech certainty indicator indicative of a level of certainty of a presence of speech in the bone conducted signal;
  - update at least one signal attenuation factor based on the speech certainty indicator; and
  - generate an updated speech level estimate output by applying the signal attenuation factor to a speech level estimate.

According to some embodiments, the processor is configured to determine the speech metric based on a difference between the input level of the bone conducted signal and a noise estimate for the bone conducted signal. In some embodiments, the noise estimate is determined by the processor applying a minima controlled recursive averaging (MCRA) window to the received bone conducted signal.

In some embodiments, the processor is further configured to apply a fast Fourier transform (FFT) to the received bone conducted signal to split the signal into frequency bands.

According to some embodiments, the processor is configured to select the speech metric threshold based on a previously determined speech certainty indicator. In some embodiments, the processor is configured to select the speech metric threshold from a high speech metric threshold and a low speech metric threshold, and wherein the high speech metric threshold is selected if the speech certainty indicator is lower than a speech certainty threshold, and the low speech metric threshold is selected if the speech certainty indicator is higher than a speech certainty threshold. In some embodiments, the speech certainty threshold is zero.

According to some embodiments, the device of any one of claims 1 to 7, wherein the processor is configured to update the speech certainty indicator to implement a hangover delay if the speech metric is larger than the speech metric threshold, and to decrement the speech certainty indicator by a predetermined decrement amount if the speech metric is not larger than the speech metric threshold. In some embodiments, the processor implements a hangover delay of between 0.1 and 0.5 seconds.

In some embodiments, the processor is further configured to reset the at least one signal attenuation factor to zero if the speech metric is determined to be greater than the speech metric threshold.

In some embodiments, the processor is configured to update the at least one signal attenuation factor if the speech certainty indicator is determined to be outside a predetermined speech certainty threshold. According to some embodiments, the predetermined speech certainty threshold is zero, and wherein the at least one signal attenuation factor is updated if the speech certainty indicator is equal to or below the predetermined speech certainty threshold.

According to some embodiments, updating the at least one signal attenuation factor comprises incrementing the signal attenuation factor by a signal attenuation step value.

In some embodiments, the at least one signal attenuation factor comprises a high frequency signal attenuation factor and a low frequency signal attenuation factor, wherein the high frequency signal attenuation factor is applied to frequencies of the bone conducted signal above a predetermined threshold, and the low frequency signal attenuation factor is applied to frequencies of the bone conducted signal below the predetermined threshold. According to some embodiments, the predetermined threshold is between 500 Hz and 1500 Hz. In some embodiments, the predetermined threshold is between 600 Hz and 1000 Hz.

According to some embodiments, applying the at least one signal attenuation factor to the speech level estimate comprises decreasing the speech level estimate by the at least one signal attenuation factor.

In some embodiments, the earbud is a wireless earbud.

In some embodiments, the bone conducted signal sensor comprises an accelerometer.

According to some embodiments, the bone conducted signal sensor is positioned on the earbud to be mechanically coupled to a wall of an ear canal of a user when the earbud is in the ear canal of the user.

Some embodiments further comprise at least one signal input component for receiving a microphone signal from an external microphone of the earbud; wherein the processor is further configured to generate the speech level estimate based on the microphone signal. According to some embodiments, the processor is further configured to apply noise suppression to the microphone signal based on the updated speech level estimate output and a noise estimate, to produce a final output signal. In some embodiments, the processor is further configured to communicate the final output signal to an external computing device.

Some embodiments relate to a system comprising the device of previously described embodiments and the external computing device.

Some embodiments relate to a method comprising:

receiving a bone conducted signal from a bone conducted signal sensor of an earbud;

determining at least one speech metric for the received bone conducted signal, wherein the speech metric is determined based on the input level of the bone conducted signal and a noise estimate for the bone conducted signal;

based at least in part on comparing the speech metric to a speech metric threshold, updating a speech certainty indicator indicative of a level of certainty of a presence of speech in the bone conducted signal;

based on the speech certainty indicator, updating at least one signal attenuation factor; and generating an updated speech level estimate output by applying the signal attenuation factor to signal speech level estimate.

In some embodiments, the speech metric may be determined based on a difference between the input level of the bone conducted signal and a noise estimate for the bone conducted signal.

According to some embodiments, the noise estimate is determined by applying a minima controlled recursive averaging (MCRA) window to the received bone conducted signal.

Some embodiments further comprise applying a fast Fourier transform (FFT) to the received bone conducted signal to split the signal into frequency bands.

In some embodiments, the speech metric threshold is selected based on a previously determined speech certainty indicator. Some embodiments further comprise selecting the speech metric threshold from a high speech metric threshold and a low speech metric threshold, wherein the high speech metric threshold is selected if the speech certainty indicator is lower than a predetermined speech certainty threshold, and the low speech metric threshold is selected if the speech certainty indicator is higher than a predetermined speech certainty threshold. In some embodiments, the predetermined speech certainty threshold is zero.

According to some embodiments, the speech certainty indicator is updated to implement a hangover delay if the speech metric is larger than the speech metric threshold, and decremented by a predetermined decrement amount if the speech metric is not larger than the speech metric threshold. In some embodiments, the processor implements a hangover delay of between 0.1 and 0.5 seconds.

Some embodiments further comprise resetting the at least one signal attenuation factor to zero if the speech metric is determined to be greater than the speech metric threshold.

Some embodiments further comprise updating the at least one signal attenuation factor if the speech certainty indicator is outside a predetermined speech certainty threshold. According to some embodiments, the predetermined speech certainty threshold is zero, and the at least one signal attenuation factor is updated if the speech certainty indicator is equal to or below the predetermined speech certainty threshold.

In some embodiments, updating the at least one signal attenuation factor comprises incrementing the signal attenuation factor by a signal attenuation step value.

According to some embodiments, the at least one signal attenuation factor comprises a high frequency signal attenuation factor and a low frequency signal attenuation factor, wherein the high frequency signal attenuation factor is applied to frequencies of the bone conducted signal above a predetermined threshold, and the low frequency signal attenuation factor is applied to frequencies of the bone conducted signal below the predetermined threshold. In some embodiments, the predetermined threshold is between 500 Hz and 1500 Hz. In some embodiments, the predetermined threshold is between 600 Hz and 1000 Hz.

According to some embodiments, applying the at least one signal attenuation factor to the speech level estimate comprises decreasing the speech level estimate by the at least one signal attenuation factor.

Some embodiments further comprise receiving a microphone signal from an external microphone of the earbud; and determining a speech level estimate based on the microphone signal. Some embodiments further comprise applying noise suppression to the microphone signal based on the updated speech level estimate output and a noise estimate, to produce a final output signal. Some embodiments further comprise communicating the final output signal to an external computing device.

Some embodiments relate to a non-transient computer readable medium storing instructions which, when executed by a processor, cause the processor to perform the method of some previously described embodiments.

BRIEF DESCRIPTION OF THE DRAWINGS

Embodiments are described in further detail below, by way of example and with reference to the accompanying drawings, in which.

DETAILED DESCRIPTION

Described embodiments generally relate to methods and systems for performing speech detection. In particular, embodiments relate to performing speech detection to enable noise reduction for speech capture functions.

Figure 1:
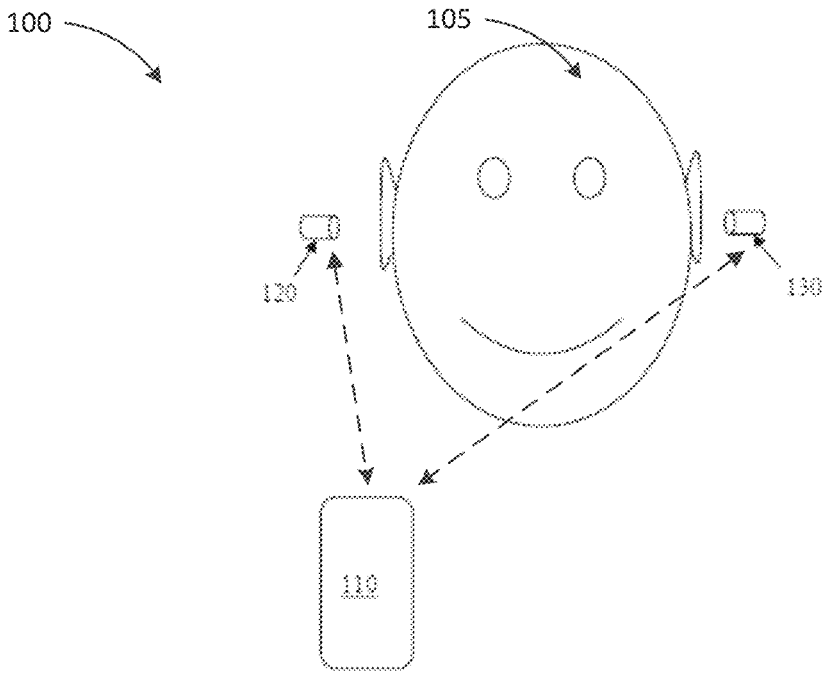
FIG. 1 illustrates a system comprising wireless earbuds for telephony and/or audio playback.

FIG. 1 illustrates a system 100 for the use of wireless earbuds for telephony and/or audio playback, the system comprising device 110 and bilateral wireless earbuds 120, 130. Device 110, which may be a smartphone or audio player or the like, is arranged to communicate with bilateral wireless earbuds 120, 130. For illustrative purposes earbuds 120, 130 are shown outside the ear of user 105. However, in use, each earbud 120, 130 is placed so that the body of the earbud 120, 130 resides substantially or wholly within the concha and/or ear canal of a respective ear of user 105. Earbuds 120, 130 may each take any suitable form to comfortably fit upon or within, and be supported by, the ear of user 105. In some embodiments, the body of the earbud 120, 130 may be further supported by a hook or support member (not shown) extending beyond the concha such as partly or completely around the outside of the respective pinna.

Figure 2:
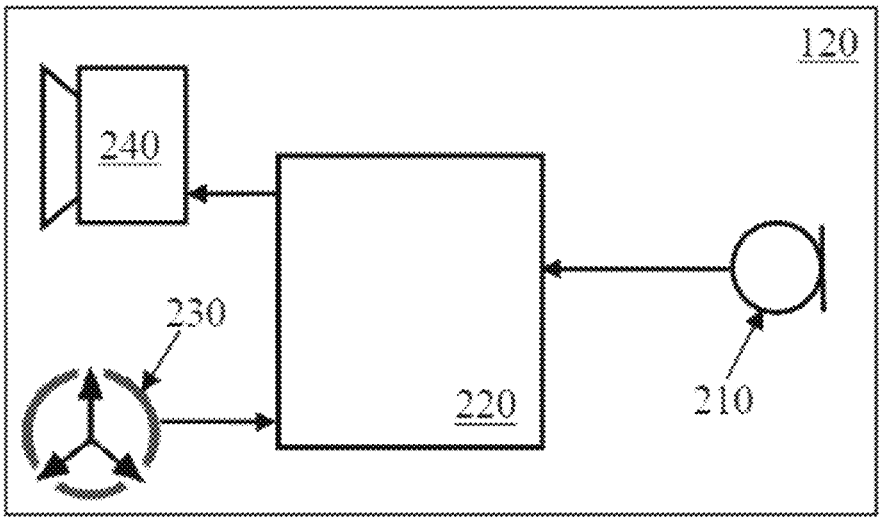
FIG. 2 is a system schematic of an earbud in accordance with one embodiment.

FIG. 2 is a schematic illustration of earbud 120 according to some embodiments. Earbud 130 may be similarly configured and is not described separately. Earbud 120 comprises microphone 210. For example, microphone 210 may be positioned on the body of the earbud 120 so as to receive external acoustic signals when the earbud is in place. According to some embodiments, microphone 210 may include a plurality of microphones, which may allow for processes such as beamforming noise reduction to be undertaken by the earbud 120. However, in some embodiments, the small size of earbud 120 may place a limitation on the maximum number of microphones and the microphone spacing which can be implemented. The positioning of the earbud 120 within the ear canal of a user where sound is partly occluded or diffused by the pinna may also limit the efficacy of processes such as beamforming, when compared to performing such processes in a different type of microphone, such as a boom-mounted microphone, for example.

Microphone 210 is in communication with a suitable processor 220. The microphone signal from microphone 210 is passed to the suitable processor 220. As earbud 120 may be of a small size in some embodiments, limited battery power may be available, which may require that processor 220 executes only low power and computationally simple audio processing functions.

Earbud 120 further comprises a bone conducted signal sensor 230. The bone conducted signal sensor 230 may be mounted upon earbud 120, for example, located on a part of the earbud 120 that is inserted into the ear canal and which may be substantially pressed against a wall of the ear canal in use. According to some embodiments, bone conducted signal sensor 230 may be mounted within the body of the earbud 120 so as to be mechanically coupled to a wall of the ear canal of a user. Bone conducted signal sensor 230 is configured to detect bone conducted signals, and in particular the user's own speech as conducted by the bone and tissue interposed between the vocal tract and the ear canal. Such signals are referred to herein as bone conducted signals, even though acoustic conduction may occur through other body tissue and may partly contribute to the signal sensed by bone conducted signal sensor 230.

According to some embodiments, bone conducted signal sensor 230 may comprise one or more accelerometers. According to some embodiments, bone conducted signal sensor 230 may additionally or alternatively comprise one or more microphones, which may be in-ear microphones in some embodiments. Such in-ear microphones will, unlike an accelerometer, receive acoustic reverberations of bone conducted signals which reverberate within the ear canal, and will also receive leakage of external noise into the ear canal past the earbud. However, it is recognised that the earbud provides a significant occlusion of such external noise, and moreover that active noise cancellation (ANC) when employed will further reduce the level of external noise inside the ear canal without significantly reducing the level of bone conducted signal present inside the ear canal, so that an in-ear microphone may indeed capture very useful bone-conducted signals to assist with speech estimation in accordance with the present invention. Additionally, such in-ear microphones may be matched at a hardware level with the external microphone 210, and may capture a broader spectrum than a bone conducted signal sensor, and thus the use of one or more in-ear microphones may present significantly different implementation challenges to the use of a bone conducted signal sensor(s).

Bone conducted signal sensor 230 could in alternative embodiments be coupled to the concha or mounted upon any part of the body of earbud 120 that reliably contacts the ear within the ear canal or concha of the user. The use of an earbud such as earbud 120 allows for reliable direct contact with the ear canal and therefore a mechanical coupling to the vibration model of bone conducted speech as measured at the wall of the ear canal. This is in contrast to the external temple, cheek or skull, where a mobile device such as a phone might make contact. It is recognised that a bone conducted speech model derived from parts of the anatomy outside the ear produces a signal that is significantly less reliable for speech estimation as compared to described embodiments. It is also recognise that use of a bone conduction sensor such as bone conducted signal sensor 230 in a wireless earbud such as earbud 120 is sufficient to perform speech estimation. This is because, unlike a handset or a headset outside the ear, the nature of the bone conducted signal from wireless earbuds is largely static with regard to the user fit, user actions and user movements. For example, no compensation of the bone conduction sensor is required for fit or proximity. Thus, selection of the ear canal or concha as the location for the bone conduction sensor is a key enabler for the present invention. In turn, the present invention then turns to deriving a transformation of that signal that best identifies the temporal and spectral characteristics of user speech.

According to some embodiments, earbud 120 is a wireless earbud. While a wired earbud may be used, the accessory cable attached to wired personal audio devices is a significant source of external vibration for bone conducted signal sensor 230. The accessory cable also increases the effective mass of the device 120 which can damp vibrations of the ear canal due to bone conducted speech. Eliminating the cable also reduces the need for a compliant medium in which to house bone conducted signal sensor 230. The reduced weight increases compliance with the ear canal vibration due to bone conducted speech. Therefore, where earbud 120 is wireless, there is no restriction, or vastly reduced restrictions, on placement of bone conducted signal sensor 230. The only requirement is that bone conducted signal sensor 230 makes rigid contact with the external housing of the earbud 120. Embodiments thus may include mounting bone conducted signal sensor 230 on a printed circuit board (PCB) inside the housing of earbud 120, or to a behind-the-ear (BTE) module coupled to the earbud kernel via a rigid rod.

The position of microphone 210 is generally close to the ear of the user when the user is wearing earbud 120. Microphone 210 is therefore relatively distant from the user's mouth, and consequently suffers from a low signal-to-noise ratio (SNR). This is in contrast to a handset or pendant type headset, in which the primary voice microphone is much closer to the mouth of the user, and in which differences in how the user holds the phone/pendant can give rise to a wide range of SNR. In the present embodiment, the SNR on microphone 210 for a given environmental noise level is not so variable, as the geometry between the user's mouth and the ear containing earbud 120 is fixed. Therefore, the ratio between the speech level on microphone 210 and the speech level on bone conducted signal sensor 230 are known a priori. Knowing the ratio between the speech levels of microphone 210 and bone conducted signal sensor 230 is useful for determining the relationship between the true speech estimate and the bone conduction sensor signal.

According to some embodiments, a sufficient degree of contact between bone conducted signal sensor 230 and the ear canal of the user may be provided due to the small weight of ear bud 120. Earbud 120 may be small enough that the force of the vibration due to speech within the car canal exceeds the minimum sensitivity of bone conducted signal sensors 230. This is in contrast to an external headset or phone handset which has a large mass, which may prevent bone conducted vibrations from easily coupling to the device.

As described in further detail below, processor 220 is a signal processing device configured to receive a bone conduction sensor signal from bone conducted signal sensor 230, and to use the received bone conduction sensor signal to condition the microphone signal generated by microphone 210. Processor 220 may further be configured to wirelessly deliver the conditioned signal to master device 110 for use as the transmitted signal of a voice call and/or for use in automatic speech recognition (ASR). Communications between earbud 120 and master device 110 may be undertaken by way of low energy Bluetooth, for example, or other wireless protocols. Alternative embodiments may utilise wired earbuds and communicate by wire, albeit with the disadvantages discussed above. Earbud 120 may also include a speaker 240, in communication with processor 220. Speaker 240 may be configured to play acoustic signals into the ear canal of the user based on instructions received from processor 220. Processor 220 may receive signals from master device 110, such as a receive signal of a voice call, and communicate these to speaker 240 for playback.

During use of earbuds 120, it is often necessary or desirable to capture the user's voice and reduce surrounding noise. An example of this is when the user is engaging in a telephony call, or using earbuds 120 to give voice commands to device 110. While previously known algorithms exist for capturing a headset user's voice, they often struggle to distinguish the user's voice from surrounding noises, especially when the noise is another person speaking nearby. The result is that the captured audio may include a lot of non-stationary noise breakthrough, even when the headset user isn't talking. In quality metrics, this can result in the audio having a poor Noise Mean Opinion Score (NMOS).

The system and method described below with reference to FIGS. 3 to 6 uses the data captured by bone conducted signal sensor 230 in combination with the data captured by microphone 210 to provide a more accurate speech estimate for use in noise reduction, resulting in the processed audio having fewer noise breakthroughs than in previously known systems.

In particular, described embodiments provide for noise reduction to be applied in a controlled gradated manner, and not in a binary on-off manner, based upon a speech estimation derived sensor signal generated by bone conducted signal sensor 230. In contrast to the binary process of voice activity detection, speech estimation as described with reference to FIGS. 3 to 6 involve speech estimation based on the sensor signal received from bone conducted signal sensor 230, and, in the absence of any voice activity detection, a process of applying biasing to the microphone signal received from microphone 210.

Accurate speech estimates can lead to better performance on a range of speech enhancement metrics. Voice activity detection (VAD) is one way of improving the speech estimate, but inherently relies on the imperfect notion of identifying in a binary manner the presence or absence of speech in noisy signals Described embodiments recognise that bone conducted signal sensor 230 can capture a suitable noise-free speech estimate that can be derived and used to drive speech enhancement directly, without relying on a binary indicator of speech or noise presence A number of solutions follow from this recognition.

Figure 3:
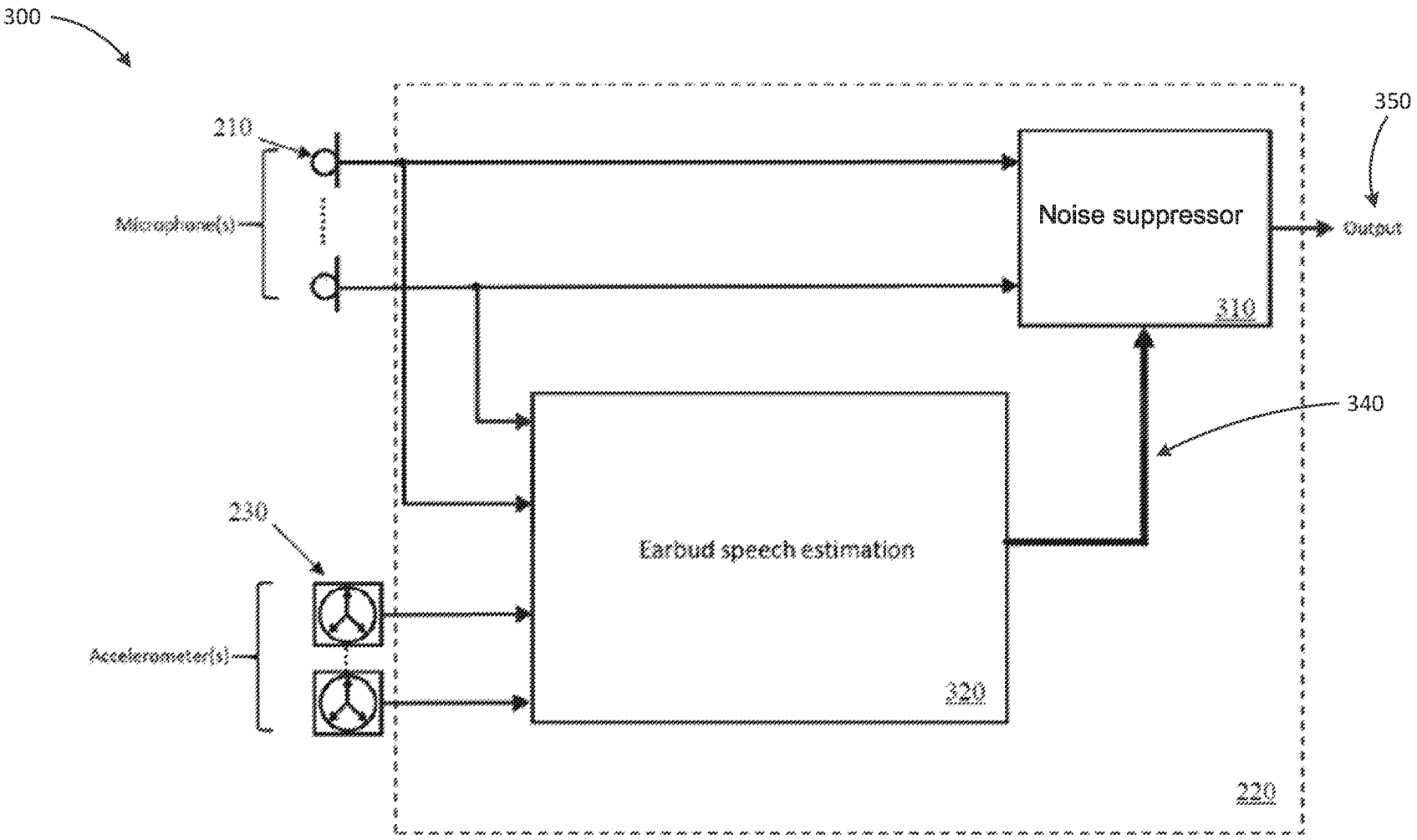
FIG. 3 is a detailed system schematic of the earbud of FIG. 2.

FIG. 3 illustrates a system 300, showing in greater detail the configuration of processor 220 within the system of earbud 120, in accordance with some embodiments. The embodiment of FIG. 3 recognises that in moderate signal to noise ratio (SNR) conditions, improved non-stationary noise reduction can be achieved with speech estimates alone, without VAD. This is distinct from approaches in which voice activity detection is used to discriminate between the presence of speech and the absence of speech, and a discrete binary decision signal from the VAD is used to gate, i.e. turn on and off, a noise suppressor acting on an audio signal. The embodiment of FIG. 3 recognises that the signal generated by bone conducted signal sensor 230, or some signal derived from this, may be relied upon to obtain sufficiently accurate speech estimates, even in acoustic conditions where accurate speech estimations cannot be obtained from the microphone signal generated by microphone 210. Omission of the VAD in such embodiments contributes to minimising the computational burden on the earbud processor 220.

System 300 comprises one or more microphones 210 and one or more bone conducted signal sensors 230. The microphone signals from microphones 210 are conditioned by a noise suppressor 310, and then passed to an output 350, such as for wireless communication to device 110. The noise suppressor 310 is continually controlled by speech estimation module 320, without any on-off gating by any VAD. Speech estimation module 320 takes inputs from one or more bone conducted signal sensors 230, and optionally, also from microphones 210, and/or other bone conducted signal sensors and microphones.

The use of an accelerometer within bone conduction sensor 230 in such embodiments is particularly useful because the noise floor in commercial accelerometers is, as a first approximation, spectrally flat. Commercial accelerometers tend to be acoustically transparent up to the resonant frequency, and so display little to no signal due to environmental noise. The noise distribution of an accelerometer within bone conducted signal sensor 230 can therefore be updated a priori to the speech estimation process. This allows for modelling of the temporal and spectral nature of the true speech signal without interference by the dynamics of a complex noise model. Experiments show that even tethered or wired earbuds can have a complex noise model due to short term changes in the temporal and spectral dynamics of noise due to events such as cable bounce. In contrast, corrections to the bone conduction spectral envelope in wireless earbud 120 are not required as a matched signal is not a requirement for the design of a conditioning parameter.

Speech estimation module 320 may perform speech estimation on the basis of certain signal guarantees in the microphone(s) 210 and bone conducted signal sensors 230. While corrections to the bone conduction spectral envelope in an earbud 120 may be performed to weight feature importance, a matched signal is not a requirement for the design of a conditioning parameter to be applied to a microphone signal generated by microphone 210. Sensor non-idealities and non-linearities in the bone conduction model of the ear canal are other reasons a correction may be applied.

Embodiments employing multiple bone conducted signal sensors 230 may be configured so as to exploit orthogonal modes of vibration arising from bone conducted speech in the ear canal in order to extract more information about the user speech. In such embodiments, the problem of capturing various modalities of bone conducted speech in the ear canal is solved by the use of multiple bone conducted signal sensors arranged orthogonally in the housing of earbud 120, or by a single bone conducted signal sensor 230 having multiple independent orthogonal axes.

According to some embodiments, speech estimation module 320 may process the signal received from bone conducted signal sensor 230, which may involve filtering and other processing steps as described in further detail below. The processed signal may then be used by speech estimation module 320 to determine a speech estimate output 340, which may comprise a single or multichannel representation of the user speech, such as a clean speech estimate, the a priori SNR, and/or model coefficients. The speech estimate output 240 can be used by noise suppressor 310 to bias the microphone signals generated by microphones 210 to apply noise suppression to detected gaps in speech.

The processing of the signal generated by bone conducted signal sensors 230 and the consequent conditioning may occur irrespective of speech activity in the bone conducted signal. The processing and conditioning are therefore not dependent on either a speech detection process or noise modelling (VAD) process in deriving the speech estimate for a noise reduction process. The noise statistics of a bone conducted signal sensor 230 measuring ear canal vibrations in a wireless earbud 120 tend to have a well-defined distribution, unlike the handset use case. Described embodiments recognise that this justifies a continuous speech estimation to be performed by speech estimation module 320 based on the signal received from bone conducted signal sensor 230. Although the microphone 210 SNR will be lower in earbud 210, due to distance of the microphone 210 from the mouth, the distribution of speech samples will have a lower variance than that of a handset or pendant due to the fixed position of the earbud and microphone 210 relative to the mouth. This collectively forms the a priori knowledge of the user speech signal to be used in the conditioning parameter design and speech estimation processes performed by speech estimation module 320.

The embodiment of FIG. 3 recognises that speech estimation using a microphone 210 and bone conducted signal sensor 230 sensor can improve speech estimation for noise suppression purposes. The speech estimate may be derived from any combination of signals from separate axes of a single bone conducted signal sensor 210. The speech estimate may be derived from time domain or frequency domain signals. By undertaking the processing within the earbud 120 rather than in master device 110, the processor 220 can be configured at a time of manufacture, and the configuration can be performed based on precise knowledge of the geometry of earbud 120.

As described in further detail below, before the non-binary variable characteristic of speech is determined from the signal generated by bone conducted signal sensor 230, the signal may be corrected for observed conditions, phoneme, sensor bandwidth and/or distortion. The corrections may involve a linear mapping which undertakes a series of corrections associated with each spectral bin, such as applying a multiplier and offset to each bin value, for example.

According to some embodiments, speech estimation module 320 may apply one or more of the following techniques: exponential filtering of signals (leaky integrator); gain function of signal values; fixed matching filter (FIR or spectral gain function); adaptive matching (LMS or input signal driven adaptation); mapping function (codebook); and using second order statistics to update an estimation routine. In addition, speech estimates may be derived from different signals for different amplitudes of the input signals, or other metric of the input signals such as noise levels.

For example, the noise floor of bone conducted signal sensor 230 may be much higher than the microphone 210 noise floor, and so below some nominal level. The bone conducted signal sensor information may no longer be as useful and the speech estimate can transition to a microphone-derived signal. The speech estimate as a function of input signals may be piecewise or continuous over transition regions.

Estimation may vary in method and may rely on different signals with each region of the transfer curve. This will be determined by the use case, such as a noise suppression long term SNR estimate, noise suppression a priori SNR reduction, and gain back-off. Further detail as to the operation of speech estimation module 320 is described below with reference to FIGS. 4 to 6.

Figure 4:
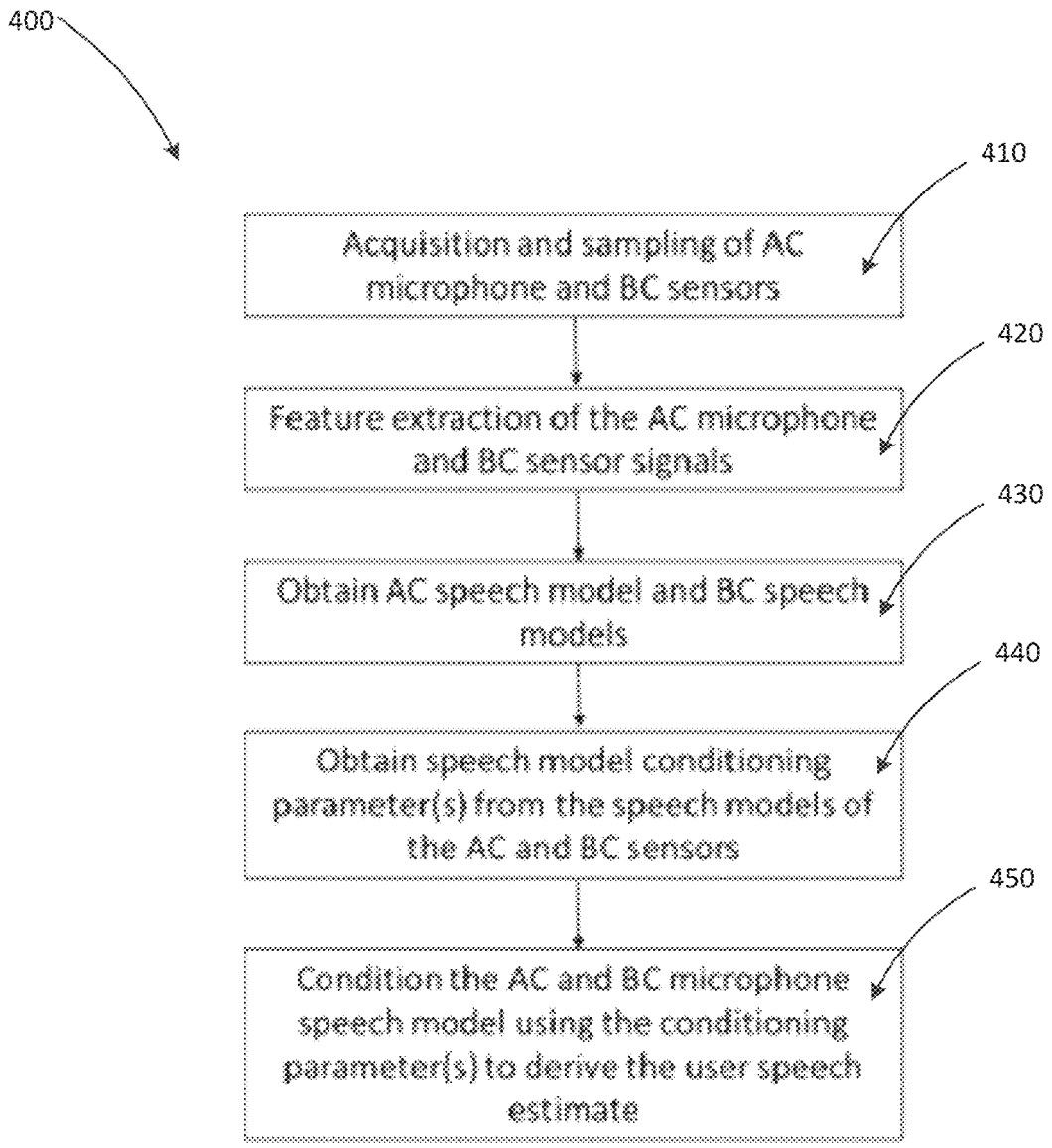
FIG. 4 is a flow diagram for the earbud noise reduction process of the earbud of FIG. 3 in accordance with some embodiments.

FIG. 4 is a flow diagram for the earbud speech estimation process as performed by processor 220. At step 410, processor 220 acquires and sampled the signals generated by microphone 210 and bone conducted signal sensor 230. At step 420, processor 220 executes feature extraction modules 321 and 322 to perform feature extraction of the signals generated by microphone 210 and bone conducted signal sensor 230. At step 430, processor 220 executes speech model modules 323 and 324 to obtain speech models of the signals generated by microphone 210 and bone conducted signal sensor 230. At step 440, processor 220 executes conditioning parameter module 326 to obtain speech model conditioning parameters based on the speech models of the signals generated by microphone 210 and bone conducted signal sensor 230. At step 450, processor 220 executes speech estimation module 328 to condition the microphone speech module generated by air conduction speech model module 323 using the conditioning parameters generated by conditioning parameter module 326 to derive the user speech estimate 340.

Figure 5:
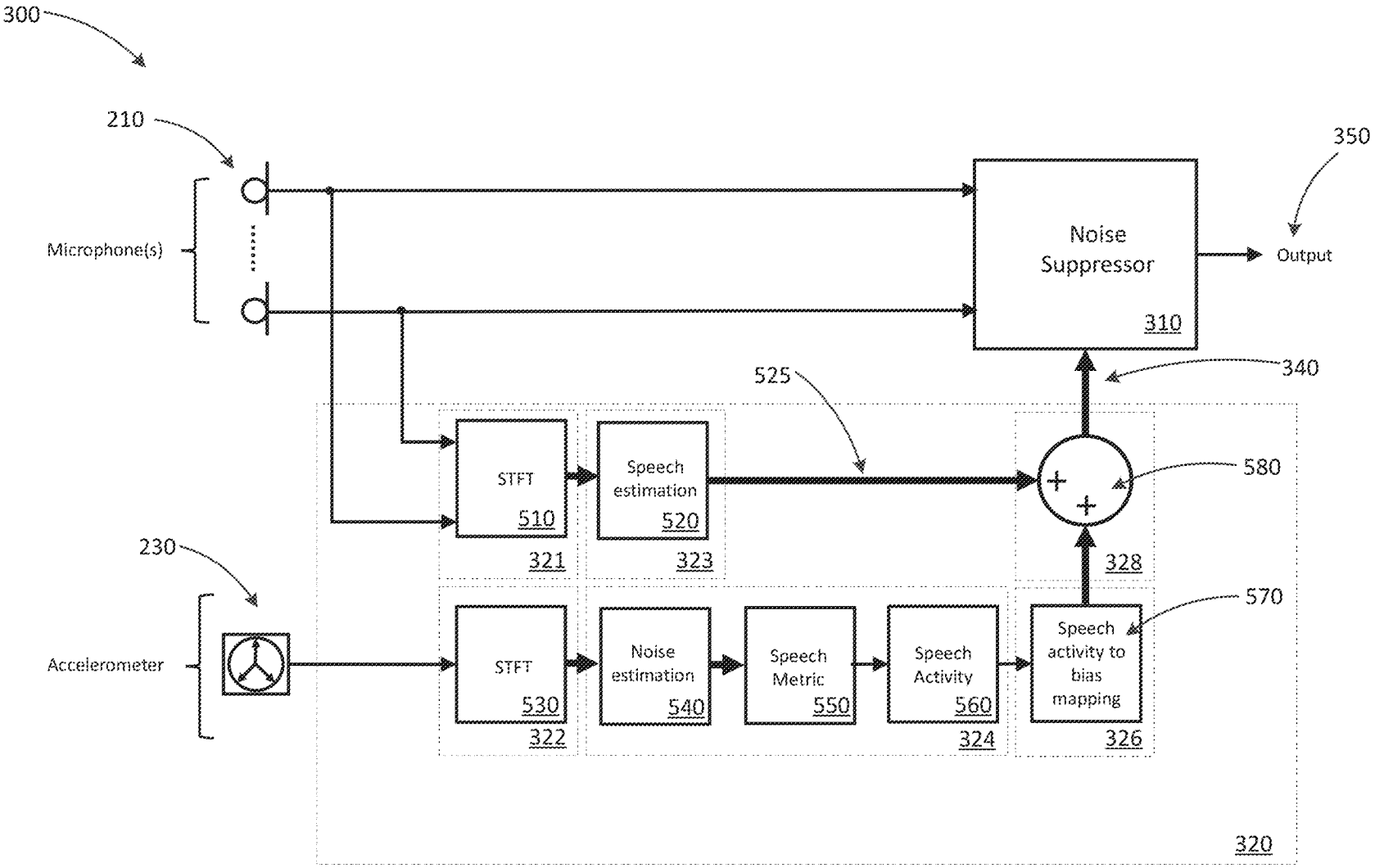
FIG. 5 is a system schematic showing the earbud of FIG. 3 in further detail.

FIG. 5 shows system 300 in further detail. Microphones 210, bone conducted signal sensors 230 and noise suppressor 310 are illustrated as shown in FIG. 3. The components of speech estimation module 320 are shown in greater detail.

Speech estimation module 320 comprises a microphone feature extraction module 321 and a bone conducted signal sensor feature extraction module 322. Feature extraction modules 321 and 322 may process signals received from microphones 210 and bone conducted signal sensors 230, respectively, to extract features such as noise estimates from the signal. According to some embodiments, feature extraction modules 321 and 322 may be configured to determine estimates of the thermal noise of the microphone 210 and bone conducted signal sensor 230, for example.

Both microphone feature extraction module 321 and bone conducted signal sensor feature extraction module 322 may include a short-time Fourier transform (STFT) module 510 and 530, respectively. STFT Modules 510 and 530 may be configured to perform an overlap-add fast Fourier transform (FFT) on the respective incoming signal. According to some embodiments, the FFT size may be 512. According to some embodiments, the FFT may use a Hanning window. According to some embodiments, the FFT may be performed in the dB domain. According to some embodiments, the FFT of the incoming signal may be grouped into log-spaced channel groupings of the incoming signal. The FFT may be performed in the time-domain, with the results grouped to break the signal into frequency bands. Various types of groupings may be used. In some embodiments, an Infinite-duration Impulse Response (IIR) filter bank, warped FFT, wavelet filter bank, or other type of FFT that splits the signal into frequency bands may be used.

Speech estimation module 320 further comprises an air conduction speech model module 323 and a bone conduction speech model module 324. Air conduction speech model module 323 may derive a speech model from the processed signal received from microphone 210 via feature extraction module 321. Bone conduction speech model module 323 may derive a speech model from the processed signal received from bone conducted signal sensor 230 via feature extraction module 322.

Air conduction speech model module 323 may include a speech estimation module 520 for determining a microphone speech estimate 525 based on the signal received from feature extraction module 321. Microphone speech estimate 525 may be a speech level estimate. Speech estimation module 520 may be configured determine microphone speech estimate 525 based on determining a filtered version of the spectral magnitude values with time constants selected that best represent the speech envelopes of the provided signal. According to some embodiments, a leaky integrator may be used to model the rise and fall of speech. In some embodiments, non-linearly transformation of spectral magnitudes may be performed to expand probable speech frequencies and compress those that are less likely. According to some embodiments, speech model module 323 may further perform a signal-to-noise ratio (SNR) reduction as a non-linear transformation. Speech model module 323 may output an array of power levels for each frequency of interest, which may be output as a level in dB.

Bone conduction speech model module 324 may comprise a noise estimation module 540. Noise estimation module 540 may be configured to update a noise estimate of the signal received from feature extraction module 322. This may be by way of applying a minima controlled recursive averaging (MCRA) window to the received signal. In some embodiments, a MCRA window of between 1 second and 5 seconds may be used. According to some embodiments, the duration of the MCRA window may be varied to capture more non-stationarity. The selection of the duration may be a compromise between responding fast enough, and correctly tracking the thermal noise produced by the bone conduction sensor, and so the duration should be set to try to capture gaps in speech to catch the noise floor. Setting a value too low may result in speech being tracked as noise, while setting a value too high would result in a processing delay.

The signal may be filtered in both time, using a time-to-collision (Ttc) of 0.001, and in frequency, using a piecewise trapezoid defined by $0.5\ X_n+0.25(X_{n-1}+X_{n+1})$.

Bone conduction speech model module 324 may further comprise a speech metric module 550. Speech metric module 550 may be configured to derive a speech metric based on the noise estimate calculated by noise estimation module 540. According to some embodiments, the speech metric may be calculated according to the formula:

$$K = \sum_{i=N_{min}}^{N_{max}} x_i - B_i$$

where $N_{max}$ and $N_{min}$ define the frequency range over which the speech metric K is determined. X defines the current input level of the signal received from bone conducted signal sensor 230, and B is the noise estimate as calculated by noise estimation module 540. Based on this, the higher the comparative level of noise in the signal, the lower the speech metric, so that the speech metric is a reflection of the strength and/or clarity of the speech signal being processed.

Speech metric module 550 may further be configured to apply hysteresis to the speech metric threshold so that a lower threshold is applied if speech is currently being detected, to reduce switching between a "speech" and a "no speech" state. For example, in some embodiments, if the current speech activity level, which may be stored as a speech certainty indicator, is determined to be greater than zero (indicating that speech activity is likely to be occurring), a low speech metric threshold may be set. If the current speech activity or speech certainty indicator is not greater than zero, such as if the current speech activity or speech certainty indicator is determined to be zero (where speech activity is unlikely to be occurring), then a high speech metric threshold may be set. According to some embodiments, the low speech metric threshold may be in the order of 2.5 dB to 3.0 dB. According to some embodiments, the high speech metric threshold may be in the order of 3.0 dB to 3.5 dB. According to some embodiments, the thresholds may be adapted according to bone conduction sensor sensitivity. According to some embodiments, the higher the sensitivity of the bone conduction sensor used, the higher the threshold may be.

Bone conduction speech model module 324 may further comprise a speech activity module 560. Speech activity module 560 may be configured to conditionally update a speech activity value, and reset a bias value when required. The bias value may be a value applied when the speech activity is determined to be zero, and may be a signal attenuation factor in some embodiments. Speech activity module 560 may be configured to check whether the speech metric K is within the particular predetermined threshold range, as determined based on the hysteresis applied by speech metric module 550. If the speech metric K is determined to be greater than the threshold, indicating the presence of speech in the signal, the speech activity value is updated to store a hangover value to implement a hangover delay. The hangover value may be a value that is incremented or decremented at a regular interval to provide a buffer after speech concludes to avoid noise suppression from occurring in small gaps in speech. The hangover value, the hangover increment or decrement amount, and the increment or decrement frequency may be set to implement a delay of a predetermined amount of time. In some embodiments, a hangover delay in the order of 0.1 seconds to 0.5 seconds may be implemented. According to some embodiments, a hangover delay of around 0.2 seconds may be implemented. The hangover delay may be selected to be of a duration approximately equal to the average length of one spoken phoneme.

Where the speech metric K is determined to be greater than the threshold, indicating the presence of speech in the signal, speech activity module 560 may be further configured to reset the frequency bias values, which may be signal attenuation factors, to zero. The frequency bias values may include a high frequency bias value, and a low frequency bias value, as described in further detail below. The high frequency bias value may be stored as a high frequency signal attenuation factor, and the low frequency bias value may be stored as a low frequency signal attenuation factor.

If the speech metric is determined to be lower than the low speech metric threshold, indicating the lack of speech in the signal, the speech activity value may be decremented to implement the hangover counter. As described above, this provides a buffer after speech concludes to avoid noise suppression from occurring in small gaps in speech. According to some embodiment, the activity value may be decremented by 1 count per frame. In some embodiments, the frames may be 4 ms frames. According to some embodiments, the speech activity value is not allowed to become less than zero.

Conditioning parameter module 326 may receive the speech models derived by modules 323 and 324 and determine conditioning parameters to be applied to a microphone signal generated by microphone 210. For example, conditioning parameter module 326 may determine the amount of biasing to apply to a speech estimation signal derived from microphone 210.

Conditioning parameter module 326 may include a speech activity to bias mapping module 570. Mapping module 570 may be configured to map frequency bias values to the speech activity determined by speech activity module 560. In particular, mapping module 570 may be configured to update the frequency bias values if the speech activity value has been decremented to zero, indicating that no speech activity is detected and that the buffer period implemented by the hangover counter has expired. If the speech activity value is determined to be equal to zero, the high frequency bias value may be incremented by a high frequency step value, and the low frequency bias value may be incremented by a low frequency step value. According to some embodiments, the high frequency bias may be capped at 5 dB, and the low frequency bias may be capped at 15 dB. According to some embodiments, the high frequency step value may be configured to cause a high frequency update rate of 10 dB per second. According to some embodiments, the low frequency step value may be configured to cause a low frequency update rate of 40 dB per second.

Mapping module 570 may further apply the frequency bias values to the microphone speech estimate 525 output by speech estimation module 520, to determine a speech estimate output 340. Speech estimate output 340 may be an updated speech level estimate output. According to some embodiments, the current input level X may be decremented by the low frequency bias value over frequencies between 0 and a predetermined bias crossover frequency $f_c$, and X may be decremented by the high frequency bias value over frequencies between the predetermined bias crossover frequency $f_c$ and the maximum frequency in the signal. According to some embodiments, the bias crossover frequency may be between 500 Hz and 1500 Hz. In some embodiments, the bias crossover frequency may be between 600 Hz and 1000 Hz. In some embodiments, the bias crossover frequency may be around 700 Hz.

Speech estimation module 328 may combine (e.g., with combiner 580) the speech estimation output produced by speech estimation module 520 with the biased speech estimate produced by mapping module 570, to produce the speech estimate output 340. In particular, speech estimation module 328 may be configured to apply the conditioning parameters determined by conditioning parameter module 326 to the speech model generated by air conduction speech model module 323. The speech estimate output 340 may then be used by noise suppressor 310 along with a noise estimate to apply noise suppression to the signal produced by microphones 210, producing the final output signal 350 to be communicated by processor 220 to device 110.

Figure 6:
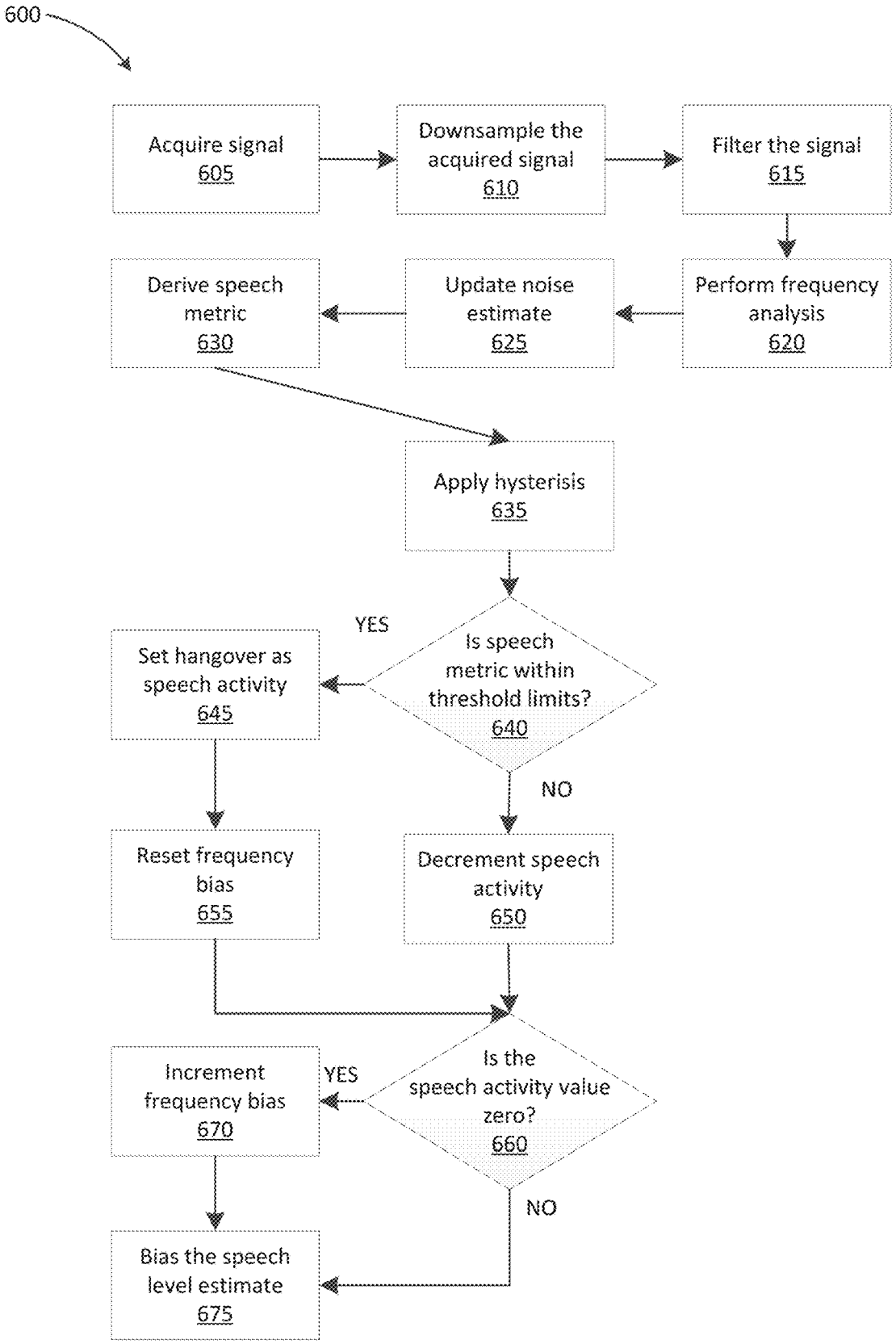
FIG. 6 is a flow diagram showing the earbud noise reduction process of FIG. 4 in further detail.

FIG. 6 shows a flow chart 600 illustrating a method of noise suppression as executed by processor 220.

At step 605, the signal from bone conducted signal sensor 230 is acquired by processor 220. At step 610, the acquired signal is downsampled. According to some embodiments, the downsampling may be performed at 48 kHz. The downsampling frequency may be selected based on the rate of sampling and the signal path of the sampling device. At step 615, the downsampled signal is filtered. According to some embodiments, the filtering may be performed using a high pass filter. According to some embodiments, the high pass filter may be a $6^{th}$ order butterworth filter. According to some embodiments, the filter may have a cutoff between 80 Hz and 120 Hz. The cutoff may be selected to suppress non-speech activity.

At step 620, frequency analysis is performed, as described above with reference to STFT module 530 of FIG. 5. The frequency analysis may be performed using an overlap-add fast Fourier transform (FFT) on the respective incoming signal. According to some embodiments, the FFT size may be 512. According to some embodiments, the FFT may use a Hanning window. According to some embodiments, the FFT may be performed in the dB domain. According to some embodiments, the FFT may be performed on log-spaced channel groupings of the incoming signal.

At step 625, the noise estimate is updated, as described above with reference to noise estimation module 540 of FIG. 5. The noise estimate may be updated by applying an MCRA window to the received signal. In some embodiments, a 5 second MCRA window may be used. The signal may be filtered in both time, using a time-to-collision (Ttc) of 0.001; and in frequency, using a piecewise trapezoid defined by $0.5X_n+0.25(X_{n-1}+X_{n+1})$.

At step 630, the speech metric is derived, as described above with reference to speech metric module 550 of FIG. 5. The speech metric may be derived based on the noise estimate calculated by noise estimation module 540. According to some embodiments, the speech metric may be calculated according to the formula:

$$K = \sum_{i=N_{min}}^{N_{max}} x_i - B_i$$

where $N_{max}$ and $N_{min}$ define the frequency range over which the speech metric K is determined. X defines the current input level of the signal received from bone conducted signal sensor 230, and B is the noise estimate as calculated by noise estimation module 540.

At step 635, hysteresis may be applied to the speech metric threshold, as described above with reference to speech metric module 550 of FIG. 5. For example, in some embodiments, if the current speech activity is determined to be greater than zero, a low speech metric threshold may be set. If the current speech activity is not greater than zero, such as if the current speech activity is determined to be zero, then a high speech metric threshold may be set. According to some embodiments, the low speech metric threshold may be in the order of 2.5 dB. According to some embodiments, the high speech metric threshold may be in the order of 3 dB.

At step 640, processor 220 determines whether the calculated speech metric is within the calculated threshold limit range. In particular, processor 220 may determine whether the calculated speech metric K is higher than the speech metric threshold selected by the hysteresis performed at step 635. If the speech metric is within the threshold limit range, indicating speech is detected, processor 220 executes step 645, by updating the speech activity value to store a hangover value to implement a hangover delay. The hangover value may be a value that is incremented or decremented at a regular interval to provide a buffer after speech concludes to avoid noise suppression from occurring in small gaps in speech. The hangover value, the hangover increment or decrement amount, and the increment or decrement frequency may be set to implement a delay of a predetermined amount of time. In some embodiments, a hangover delay in the order of 0.1 seconds to 0.5 seconds may be implemented. According to some embodiments, a hangover delay of around 0.2 seconds may be implemented. The hangover delay may be selected to be of a duration approximately equal to the average length of one spoken phoneme.

Processor 220 may subsequently execute step 655, at which the frequency bias values are reset to zero. The frequency bias values may include a high frequency bias value, and a low frequency bias value, as described above.

If the speech metric is not within the threshold limit range, indicating a lack of speech, processor 220 may execute step 650, at which the speech activity value may be decremented to implement a buffer at the conclusion of speech. According to some embodiments, the speech activity value is not allowed to become less than zero.

Following steps 650 or 655, processor 220 performs step 660. At step 660, processor 220 determines whether speech activity is detected, by determining whether or not the speech activity value is equal to zero. If the speech activity value is determined to be equal to zero, as no speech is determined to be detected and the buffer period has expired, then processor 220 may be configured to execute step 670. At step 670, the high frequency bias value may be incremented by a high frequency step value, and the low frequency bias value may be incremented by a low frequency step value. According to some embodiments, the high frequency bias may be capped at 5 dB, and the low frequency bias may be capped at 15 dB. According to some embodiments, the high frequency step value may be configured to cause a high frequency update rate of 10 dB per second. According to some embodiments, the low frequency step value may be configured to cause a low frequency update rate of 40 dB per second.

If the speech activity value is determined to not be equal to zero, as speech is determined to be detected, then processor 220 may be configured to execute step 665.

Following step 660 or step 670, processor 220 performs step 675. At step 675, the bias values are applied to the microphone speech estimate 525, to determine a speech estimate output 340. Speech estimate output 340 may be an updated speech level estimate output. According to some embodiments, the microphone speech estimate 525 may be decremented by the low frequency bias value over frequencies between 0 and a predetermined bias crossover frequency $f_c$, and X may be decremented by the high frequency bias value over frequencies between the predetermined bias crossover frequency $f_c$ and the maximum frequency in the signal. According to some embodiments, the bias crossover frequency may be between 500 Hz and 1500 Hz. In some embodiments, the bias crossover frequency may be between 600 Hz and 1000 Hz. In some embodiments, the bias crossover frequency may be around 700 Hz.

Figure 7B:
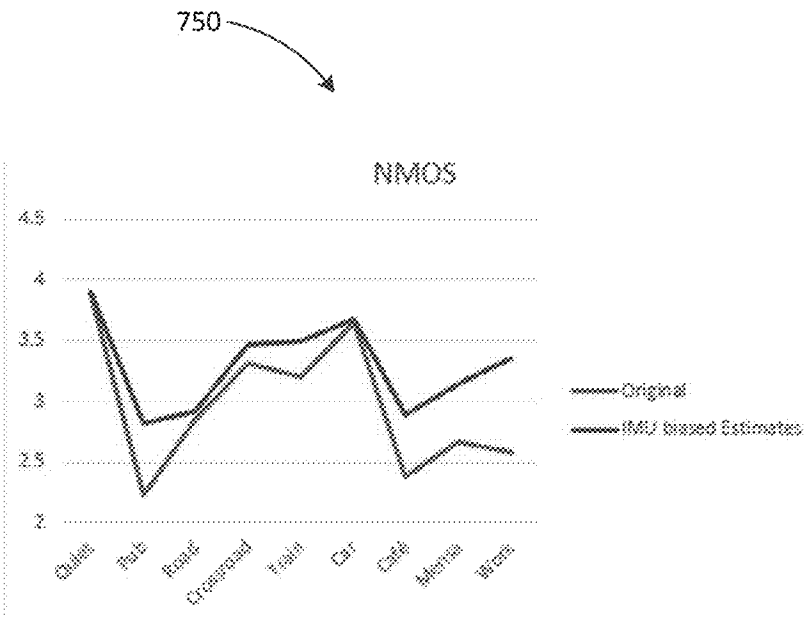
FIGS. 7A and 7B show Mean Opinion Score (MOS) results for one embodiment of the invention.
Figure 7A:
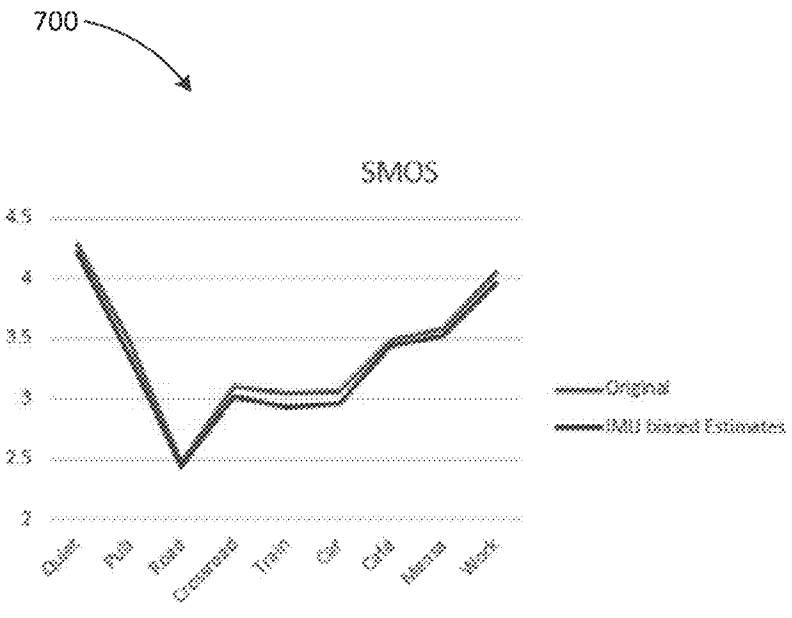

FIGS. 7A and 7B show objective Mean Opinion Score (MOS) results 700 and 750 for the embodiment of FIG. 6, showing the improvement when the a priori speech envelope from the microphone 210 is biased using the values derived from bone conducted signal sensor 230. The measurements are performed in a number of different stationary and non-stationary noise types using the 3Quest methodology to obtain speech MOS (S-MOS) and noise MOS (N-MOS) values.

While in other applications, such as handsets, bone conduction and microphone spectral estimates in the combined estimates have time and frequency contribution that may fall to zero if the handset use case forces either sensor signal quality to be very poor, this is not the case in the wireless earbud application of the present embodiments. In contrast, the a priori speech estimates of the microphone 210 and bone conducted signal sensor 230 in the earbud form factor can be combined in a continuous way. For example, provided the earbud 120 is being worn by the user, the bone conducted signal sensor model will generally always provide a signal representative of user speech to the conditioning parameter design process. As such, the microphone speech estimate is continuously being conditioned by this parameter.

While the described embodiments provide for the speech estimation module 320 and the noise suppressor module 310 to reside within earbud 120, alternative embodiments may instead or additionally provide for such functionality to be provided by master device 110. Such embodiments may thus utilise the significantly greater processing capabilities and power budget of master device 110 as compared to earbuds 120, 130.

Earbud 120 may further comprise other elements not shown such as further digital signal processor(s), flash memory, microcontrollers, Bluetooth radio chip or equivalent, and the like.

The claimed electronic functionality can be implemented by discrete components mounted on a printed circuit board, or by a combination of integrated circuits, or by an application-specific integrated circuit (ASIC). Wireless communications is to be understood as referring to a communications, monitoring, or control system in which electromagnetic or acoustic waves carry a signal through atmospheric or free space rather than along a wire.

Corresponding reference characters indicate corresponding components throughout the drawings.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

The invention claimed is:

1. A device comprising:

at least one signal input component for receiving a bone conducted signal from a bone conducted signal sensor of an earbud;

memory storing executable code; and a processor configured to access the memory and execute the executable code, wherein executing the executable code causes the processor to:

receive the bone conducted signal;

determine at least one speech metric for the received bone conducted signal, wherein the speech metric is based on the input level of the bone conducted signal and a noise estimate for the bone conducted signal;

based at least in part on comparing the speech metric to a speech metric threshold, update a speech certainty indicator indicative of a level of certainty of a presence of speech in the bone conducted signal;

update at least one signal attenuation factor based on the speech certainty indicator; and generate an updated speech level estimate output by applying the signal attenuation factor to a speech level estimate;

wherein the processor is configured to update the speech certainty indicator to implement a hangover delay if the speech metric is larger than the speech metric threshold, and to decrement the speech certainty indicator by a predetermined decrement amount if the speech metric is not larger than the speech metric threshold.

2. The device of claim 1, wherein the processor is configured to determine the speech metric based on a difference between the input level of the bone conducted signal and a noise estimate for the bone conducted signal.

3. The device of claim 2, wherein the noise estimate is determined by the processor applying a minima controlled recursive averaging (MCRA) window to the received bone conducted signal.

4. The device of claim 1, wherein the processor is configured to select the speech metric threshold based on a previously determined speech certainty indicator.

5. The device of claim 4, wherein the processor is configured to select the speech metric threshold from a high speech metric threshold and a low speech metric threshold, and wherein the high speech metric threshold is selected if the speech certainty indicator is lower than a speech certainty threshold, and the low speech metric threshold is selected if the speech certainty indicator is higher than a speech certainty threshold.

6. The device of claim 1, wherein the processor implements a hangover delay of between 0.1 and 0.5 seconds.

7. The device of claim 1, wherein the processor is further configured to reset the at least one signal attenuation factor to zero if the speech metric is determined to be greater than the speech metric threshold.

8. The device of claim 1, wherein the processor is configured to update the at least one signal attenuation factor if the speech certainty indicator is determined to be outside a predetermined speech certainty threshold.

9. The device of claim 8, wherein the predetermined speech certainty threshold is zero, and wherein the at least one signal attenuation factor is updated if the speech certainty indicator is equal to or below the predetermined speech certainty threshold.

10. The device of claim 1, wherein updating the at least one signal attenuation factor comprises incrementing the signal attenuation factor by a signal attenuation step value.

11. The device of claim 1, wherein the at least one signal attenuation factor comprises a high frequency signal attenuation factor and a low frequency signal attenuation factor, wherein the high frequency signal attenuation factor is applied to frequencies of the bone conducted signal above a predetermined threshold, and the low frequency signal attenuation factor is applied to frequencies of the bone conducted signal below the predetermined threshold.

12. The device of claim 11, wherein the predetermined threshold is between 500 Hz and 1500 Hz, preferably wherein the predetermined threshold is between 600 Hz and 1000 Hz.

13. The device of claim 1, wherein applying the at least one signal attenuation factor to the speech level estimate comprises decreasing the speech level estimate by the at least one signal attenuation factor.

14. The device of claim 1, wherein the earbud is a wireless earbud.

15. The device of claim 1, wherein the bone conducted signal sensor comprises an accelerometer.

16. The device of claim 1, wherein the bone conducted signal sensor is positioned on the earbud to be mechanically coupled to a wall of an ear canal of a user when the earbud is in the ear canal of the user.

17. The device of claim 1, further comprising at least one signal input component for receiving a microphone signal from an external microphone of the earbud; wherein the processor is further configured to generate the speech level estimate based on the microphone signal.

18. The device of claim 17, wherein the processor is further configured to apply noise suppression to the microphone signal based on the updated speech level estimate output and a noise estimate, to produce a final output signal.

19. A method comprising:

receiving a bone conducted signal from a bone conducted signal sensor of an earbud;

determining at least one speech metric for the received bone conducted signal, wherein the speech metric is determined based on the input level of the bone conducted signal and a noise estimate for the bone conducted signal;

based at least in part on comparing the speech metric to a speech metric threshold, updating a speech certainty indicator indicative of a level of certainty of a presence of speech in the bone conducted signal;

based on the speech certainty indicator, updating at least one signal attenuation factor; and generating an updated speech level estimate output by applying the signal attenuation factor to signal speech level estimate;

wherein the speech certainty indicator is updated to implement a hangover delay if the speech metric is larger than the speech metric threshold, and the speech certainty indicator is decremented by a predetermined decrement amount if the speech metric is not larger than the speech metric threshold.

20. A non-transient computer readable medium storing instructions which, when executed by a processor, cause the processor to perform the method of claim 19.

* * * * *